United States Patent [19]

Collins

[11] Patent Number: 4,944,508

[45] Date of Patent: Jul. 31, 1990

[54] SHOULDER REHABILITATION DEVICE

[76] Inventor: Jayson H. Collins, 5804 Parkwood, Austin, Tex. 78735

[21] Appl. No.: 392,307

[22] Filed: Aug. 10, 1989

[51] Int. Cl.[5] ..... A63B 21/015

[52] U.S. Cl. ..... 272/132; 272/136; 272/116; 272/DIG. 4

[58] Field of Search ..... 272/901, 67, 68, 116, 272/132, 131, 142, 136, 135, 900, DIG. 4

[56] References Cited

U.S. PATENT DOCUMENTS

| | | | |
|---|---|---|---|
| 2,817,524 | 12/1957 | Sadler | 272/132 |
| 3,567,219 | 3/1971 | Foster | 272/135 |
| 3,620,530 | 11/1971 | Cosby | 272/142 |
| 3,662,602 | 5/1972 | Weiss | 272/142 X |
| 4,408,759 | 10/1983 | Reneau et al. | 272/131 |
| 4,509,747 | 4/1985 | Martin | 272/901 X |
| 4,743,019 | 5/1988 | Lequeux | 272/132 |

*Primary Examiner*—Richard J. Apley
*Assistant Examiner*—H. N. Flaxman
*Attorney, Agent, or Firm*—Joseph F. Long

[57] ABSTRACT

A shoulder rehabilitation device is described wherein the forearm is cradled in a movable lever on a mounting plate with the mounting plate hinged to a base plate in such a manner that the arm movement at various angles between horizontal and vertical exercises all the muscles in the shoulder; a structure of adjusting resistance to motion of the lever provides for prescribed exercise as the muscles strengthen.

5 Claims, 3 Drawing Sheets

SHOULDER REHABILITATION DEVICE

BACKGROUND OF THE INVENTION

This invention is directed toward a unit to allow exercising of all the muscles in a persons shoulder in a measurable repeatable fashion.

After many types of injuries to the body, physical therapy is required to restore the injured member to previous capability. Commonly, various exercise devices may be used by the physical therapist. Our patent search uncovered the several patents listed below which were directed to exercising to build muscles in the arm; usually in a manner to mimic arm wrestling. We did not find prior art directed toward rehabilitation of an injured shoulder.

The following patents have been considered:

| Serial No. | Date |
|---|---|
| 4811944 | 3/14/89 |
| 4509747 | 4/9/85 |
| 4461474 | 7/24/84 |
| 4423862 | 1/3/84 |
| 3742284 | 7/3/73 |
| 3662602 | 5/16/72 |
| 3563542 | 2/16/71 |

The abstract of a German patent, October 1978 DT No. 2716046 indicated an apparatus to strengthen arm and shoulder muscles but movement was in only one plane and the unit would not suffice for the necessary exercise for shoulder rehabilitation.

The invention encompasses a lever arm with means to increase resistance to motion of the lever arm and means to hold the lever arm at various angles during use.

The unit may be equipped: (1) with a counter to indicate swings of a lever arm; (2) a some indication of force needed to swing the lever arm; and (3) read out of angle or position of mounting plate for the lever arm relative to the horizontal along with a counter, a force measure, and a resettable clock type mechanism with an alarm to indicate to the user the end of time in a period he has chosen.

SUMMARY OF THE INVENTION

The invention in a preferred embodiment will be described in more detail under the description of the drawings. Briefly, the invention comprises a lever arm with a cradle for a patient's forearm approximately five inches wide and twelve inches long with the lever arm pivotally mounted on a flat mounting plate hinged to a base plate. A means of increasing resistance to motion of the lever arm adjusts the force the patient must exert to move the lever arm. The mounting plate is provided with an adjustable support so that the unit may be tilted in order that it may be used lying horizontal on a table or may be tilted upward to a 90 degree angle. The lever arm is pivoted near the edge of the mounting plate nearest the user. The means of adjusting force necessary to move the lever arm or resistance to motion of the lever arm may be a hydraulic cylinder, springs, elastic straps or frictional pressure against the lever arm pivot pin.

Moving the lever arm with the mounting plate at various angles to the base plate as may be prescribed by a therapist results in exercising part of the muscles in the shoulder in each position as well as muscles in the arm.

DETAILED DESCRIPTION OF THE DRAWINGS

Figure 1:
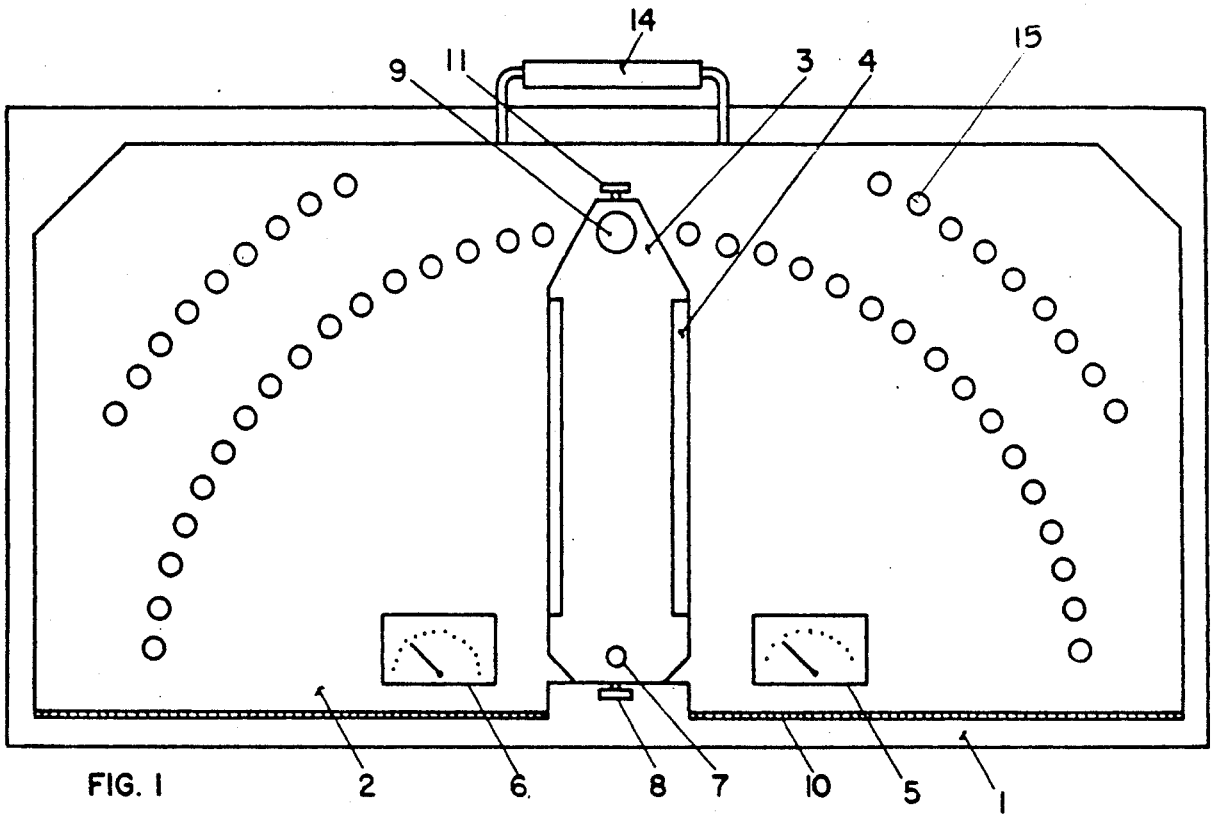
FIG. 1 shows a top view of first embodiment with the mounting plate 2 lying flat on the base plate 1 with tension adjustment knob 8.

In FIG. 1 we show a top view of the invention. In this embodiment a mounting plate 2 is shown attached with piano hinges 10 to base plate 1. A lever arm 3 with a forearm cradle 4 is pivotally attached to the mounting plate 2 with pivot pin 7. The forearm cradle 4 may be raised sides 4 with padding. A tension adjustment 8 shown in more detail in FIG. 4 adjusts resistance to movement of lever arm 3. We've shown a resettable time indicator or timer 5 which may be set to any interval up to an hour. A counter 6 indicates the number of movements of lever arm 3. The end of lever arm 3 is equipped with a support roller 11 to allow smooth easy motion. Hand gripping post 9 is mounted in lever arm 3 in such a manner that it may be moved downward approximately ½ inch to fit into one of the holes 15 arranged in a semi-circular fashion in the mounting plate 2. A carrying handle 14 improves portability of the unit.

Figure 2:
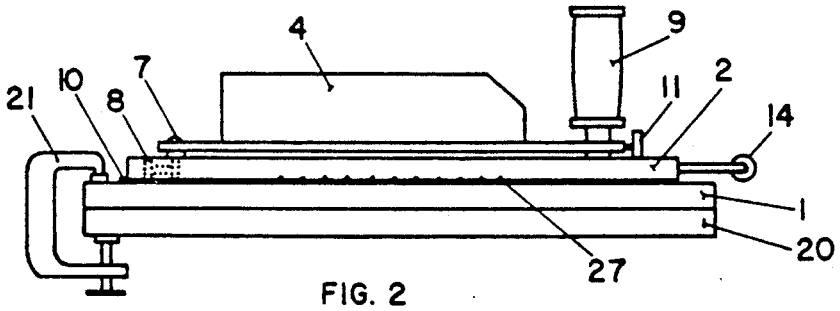
FIG. 2 shows a side view of the first embodiment lying in a horizontal position with clamp 21 to clamp the unit to a table top 20.

If FIG. 2 we've shown a side view with hinge 10 connecting base plate 1 to mounting plate 2 and with base plate 1 clamped to a table top 20 with clamps 21. This FIG. 2 also shows a side view of forearm cradle 4 relative to hand gripping post 9. Pivot pin 7 and tension adjustment knob 8 are shown dotted to show their relative position. In a preferred embodiment the forearm cradle 4 is padded with waterproof padding.

Figure 3:
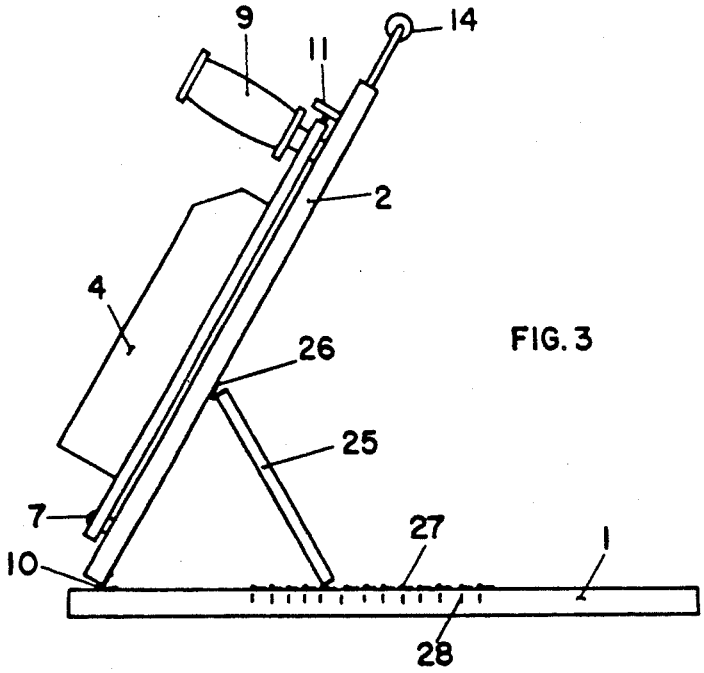
FIG. 3 shows the unit with the mounting plate at approximately 60 degree angle to the base plate with a hinged angle adjustment bar and with angle calibration marks.

In FIG. 3 we show a side view with mounting plate 2 connected to base plate 1 with piano hinge 10. Other type hinges could be used but piano type hinge is preferred. Two angle adjustment bars 25 are hinged with hinges 27 on each side of mounting plate 2 so as to swing downward to pin fasteners 27 to allow rigidly fixing mounting plate 2 to base plate 1 at various angles. Pin fasteners 27 may be as simple as one side of a pin type hinge mounted on angle adjustment bar 25 with multiple other sides of a similar hinge mounted to base plate 1 allowing rigid connection by sliding a pin to rigidly connect the two parts of the hinge. A calibration strip 28 indicates the angle formed between the mounting plate 2 and base plate 1 for various positions of mounting arm 25.

Figure 4:
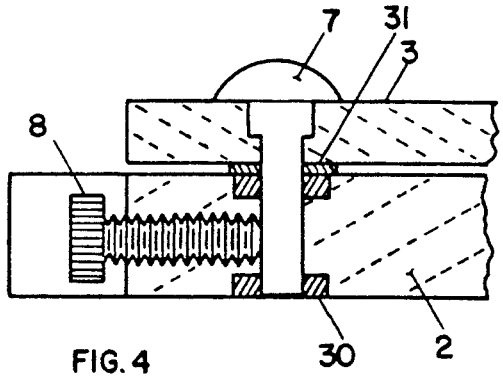
FIG. 4 shows a detail view of tension adjustment using a threaded pin to exert pressure against pivot pin 7.

In FIG. 4 we've shown in detail a tension adjustment knob 8 with the attached threaded pin threaded into a threaded housing contained in mounting plate 2 so as to exert pressure against the pivot pin 7. The pivot pin 7 is preferably of hardened steel with a square portion to allow rigidly affixing the head of the pivot pin 7 to the lever arm 3. Dual bearings 30 are rigidly affixed in mounting plate 2 by keying into the base or gluing therein. A large washer 31 is used along with support wheel 9 to prevent lower arm 3 from rubbing on mounting plate 2.

Figure 5:
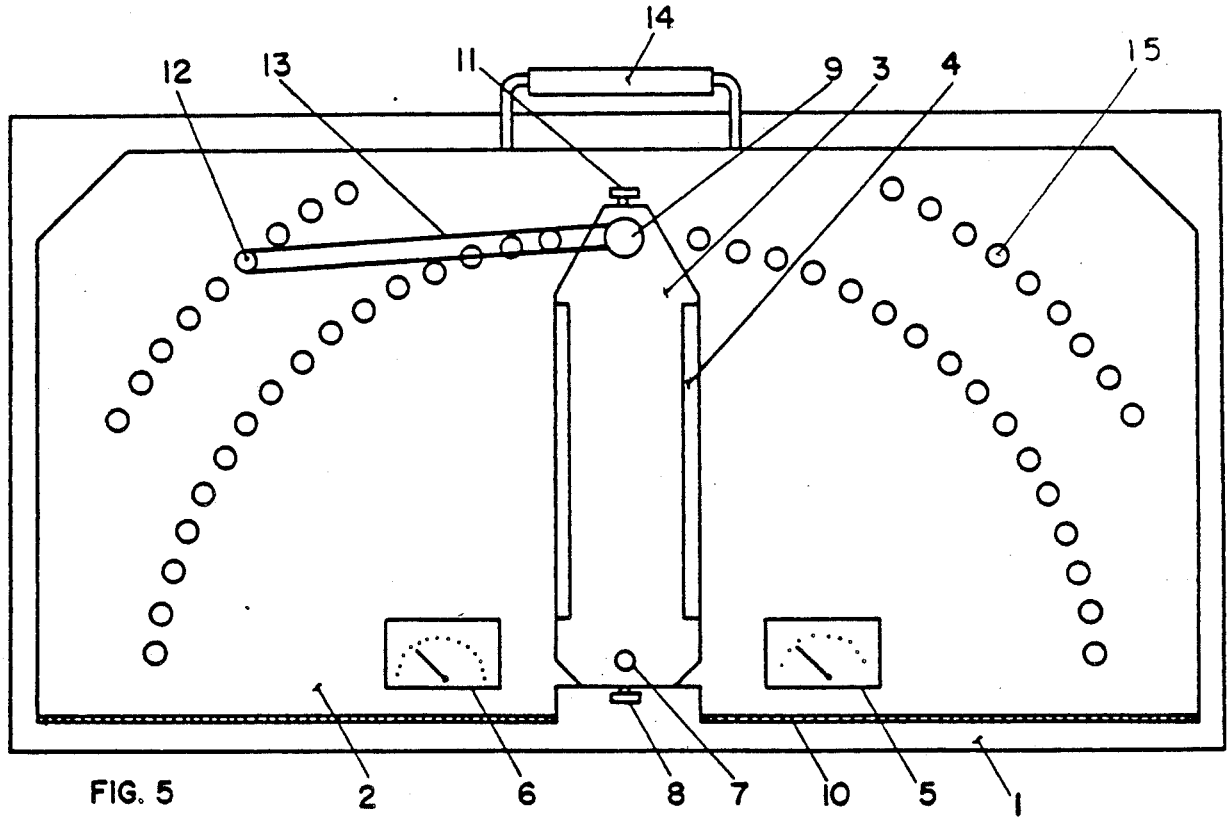
FIG. 5 is a second embodiment and is similar to FIG. 1 except an elastic band 13 furnishes adjustable resistance to motion of lever 3.

In FIG. 5 we show a top view of a second embodiment quite similar to the first embodiment in FIG. 1 except resistance to movement of lever arm 3 is furnished by an elastic band 13 that movably connects anchor pin 12 with hand gripping post 9.

Many minor changes or additions could easily be made by one skilled in mechanical arts so we do not wish to be limited to exact details but only as to general spirit and purpose as outlined in these claims and specifications.

In use, the patient, following directions of a therapist, may exercise the shoulder by moving the lever against either a minimal or maximum resistance for a set number of times or a prescribed time period with the mounting plate at different prescribed angles. In this way all the shoulder muscles may be exercised.

LEGEND

1=base plate
2=mounting plate
3=lever arm
4=arm cradle
5=timer—to set timer in a period
6=counter—to count swings of the lever arm
7=pivot pin
8=tension adjustment knob
9=hand gripping post
10=hinge—such as piano hinge
11=lever support wheel
12=anchor pin
13=elastic band
14=carrying handle
20=table top
21=clamps
25=angle adjustment bar
26=hinge
27=pin fastener
28=angle calibration
30=pivot pin sleeve bearing
31=spacer washer

What is claimed is:

1. A multi-angle shoulder rehabilitation unit comprising:

(a) a base plate;

(b) a mounting plate means hingedly attached to said base plate with adjustable means to rigidly hold said mounting plate means in a multiplicity of different positions from horizontal to vertical;

(c) a lever means affixed at a lower end with a pivotal mounting means to said mounting plate means;

(d) a gripping handle means mounted at right angles to and in the upper end of said lever means; a multiplicity of holes in said mounting plate means, wherein said gripping handle means is movably mounted within said lever means to engage any one of said multiplicity of holes in said mounting plate means;

(e) a forearm cradle means mounted on said lever means between said gripping handle mounting means and said pivotal mounting means; and (f) a tension adjustment means to adjust resistance to motion of said lever means.

2. A multi-angle shoulder rehabilitation unit as in claim 1 where said tension adjustment means is an adjustable screw means to put pressure against said pivotal mounting means to adjust resistance to motion of said lever means.

3. A multi-angle shoulder rehabilitation unit as in claim 1 where said tension adjustment means is an elastic band that stretches between said gripping handle means and a movable anchor pin in said mounting plate means.

4. A multi-angle shoulder rehabilitation unit as in claim 1 wherein an adjustable timer with an alarm is mounted in said mounting plate means.

5. A multi-angle shoulder rehabilitation unit as in claim 4 wherein a counter to read out total number of swings of said lever means is mounted in said mounting plate means.

* * * * *